US008523513B2

(12) United States Patent
Ikeya et al.

(10) Patent No.: US 8,523,513 B2
(45) Date of Patent: Sep. 3, 2013

(54) FUEL PUMP

(75) Inventors: Masaki Ikeya, Obu (JP); Akio Muraishi, Obu (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 1380 days.

(21) Appl. No.: 11/850,073

(22) Filed: Sep. 5, 2007

(65) Prior Publication Data

US 2008/0253878 A1 Oct. 16, 2008

(30) Foreign Application Priority Data

Sep. 15, 2006 (JP) ..... 2006-251619

(51) Int. Cl.
*F04D 29/08* (2006.01)
*F04D 29/12* (2006.01)

(52) U.S. Cl.
USPC ..... 415/55.1

(58) Field of Classification Search
USPC ..... 415/55.1–55.7; 416/174
See application file for complete search history.

(56) References Cited

U.S. PATENT DOCUMENTS

| | | | | |
|---|---|---|---|---|
| 2,420,557 | A * | 5/1947 | Mueller | 415/110 |
| 3,095,820 | A * | 7/1963 | Sanborn et al. | 415/55.4 |
| 3,111,904 | A * | 11/1963 | Burns | 415/123 |
| 3,647,311 | A * | 3/1972 | Wootton et al. | 415/113 |
| 3,964,843 | A * | 6/1976 | Terazawa et al. | 418/83 |
| 4,389,050 | A * | 6/1983 | Johnson et al. | 277/360 |
| 4,397,446 | A * | 8/1983 | Jelinek | 251/309 |
| 4,806,073 | A | 2/1989 | Schonwald | |
| 4,992,022 | A * | 2/1991 | Aust et al. | 415/121.2 |
| 5,137,418 | A * | 8/1992 | Sieghartner | 415/55.1 |
| 5,429,476 | A | 7/1995 | Krauter et al. | |
| 6,866,488 | B2 * | 3/2005 | Olivier et al. | 417/423.4 |
| 7,025,561 | B2 * | 4/2006 | Honda et al. | 415/55.1 |
| 7,165,931 | B2 * | 1/2007 | Olivier et al. | 415/55.2 |
| 2002/0021961 | A1 * | 2/2002 | Pickelman et al. | 415/55.1 |
| 2002/0131860 | A1 * | 9/2002 | Takei | 415/55.4 |

FOREIGN PATENT DOCUMENTS

| | | |
|---|---|---|
| DE | 2220076 | 11/1973 |
| DE | 4415566 | 11/1995 |
| JP | 57114195 | 12/1955 |
| JP | 5660892 | 5/1981 |
| JP | 6213195 | 8/1994 |
| JP | 11173289 | 6/1999 |
| JP | 2002349468 | 12/2002 |
| JP | 2003184779 | 7/2003 |
| JP | 2005320913 | 11/2005 |

OTHER PUBLICATIONS

German Patent Office Action mailed on Dec. 11, 2012, and an English translation thereof.

* cited by examiner

*Primary Examiner* — Nathaniel Wiehe
*Assistant Examiner* — Sean J Younger
(74) *Attorney, Agent, or Firm* — Ladas & Parry, LLP

(57) ABSTRACT

A fuel pump is provided with a casing and a substantially disk-shaped impeller that can rotate within the casing. A group of concavities is formed in each surface of the impeller. The concavities forming the group are arranged in concentric circles with respect to the rotation axis of the impeller. A first groove is formed in a first inner surface of the casing and extends from an upstream end to a downstream end in an area that faces one group of concavities. A second groove is formed in a second inner surface of the casing and extends from an upstream end to a downstream end in an area that faces the other group of concavities. A seal portion is formed in at least one of the first and second inner surfaces of the casing and formed by one layer or a plurality of layers of thin film.

16 Claims, 14 Drawing Sheets

FUEL PUMP

CROSS-REFERENCE TO RELATED APPLICATION

This application claims priority to Japanese Patent Application No. 2006-251619 filed on Sep. 15, 2006, the contents of which are hereby incorporated by reference into the present application.

BACKGROUND OF THE INVENTION

1. Field of the Invention

The present invention relates to a fuel pump that draws in a fuel, increases the pressure thereof, and discharges the pressurized fuel.

2. Description of the Related Art

A known fuel pump generally comprises a casing and an impeller rotatably disposed within the casing. A first group of concavities is formed in a lower surface of the impeller. A second group of concavities is formed in an upper surface. The concavities are repeated in a circumferential direction. A first groove is formed in a first inner surface of the casing in an area that faces the first group of concavities of the impeller. A second groove is formed in a second inner surface of the casing in an area that faces the second group of concavities of the impeller. The first and second grooves extend in a circumference direction from an upstream end to a downstream end, respectively. A pump channel is formed inside the casing by the groups of concavities of the impeller and the grooves of the casing. An intake hole and a discharge hole are formed in the casing. The intake hole links the upstream end of the pump channel and the exterior of the casing. The discharge hole links the downstream end of the pump channel and the exterior of the casing. When the impeller rotates, the fuel is drawn from the intake hole into the pump channel. The fuel drawn into the pump channel flows from the upstream end to the downstream end of the pump channel, while the pressure thereof is increased. The pressurized fuel is discharged to the outside of the casing via the discharge hole.

In this known fuel pump, a clearance is provided between the casing and the impeller. Where the clearance is large, the fuel in the pump channel easily leaks from the pump channel to the clearance and high pump efficiency cannot be obtained. Therefore, in order to obtain high pump efficiency, it is necessary to decrease the clearance and reduce fuel leakage from the pump channel. However, if the clearance is too small, the casing and the impeller come into surface contact and sliding resistance increases, thereby decreasing pump efficiency. Thus, because of this trade-off relationship between the reduction in sliding resistance and reduction in fuel leakage, a technology is required that can realize the two at the same time.

Japanese Laid-open Patent Application Publication No. 6-213195 discloses a fuel pump in order to solve this problem. In this fuel pump, a plurality of concave portions is formed in the entire inner surface of the casing. The concave portions are formed as dots or grooves, and the concave portions are separated from each other. By forming a plurality of concave portions in the inner surface of the casing, the surface tension of the fuel increases and the adhesion force of the fuel inside the clearance between the casing and the impeller increases. As a result, sealing capacity can be improved without unnecessarily reducing the clearance between the casing and the impeller. Thus, with this fuel pump, both the reduction of fuel leakage and the reduction of sliding resistance can be realized.

BRIEF SUMMARY OF THE INVENTION

In the above-described fuel pump, because a plurality of concave portions is formed in the inner surface of the casing, it is necessary to perform complex cutting of the casing. Moreover, because a high degree of precision is required for this cutting operation, manufacturing cost increases. Moreover, where the concave portions are formed by mechanical processing such as cutting, there is a variation in the shape of concave portions. As a result, there is a variation in pump efficiency. For these reasons, with the above-described technology, it is difficult to realize both the reduction in fuel leakage and the reduction in sliding resistance at a low manufacturing cost and with good stability.

It is one object of the present teachings to provide a fuel pump that can be manufactured at a low cost and in which both the reduction of fuel leakage and the reduction in sliding resistance can be realized with good stability.

In one aspect of the present teachings, a fuel pump is provided with a casing and a substantially disc-shaped impeller rotatably disposed within the casing. A first group of concavities is formed in a lower surface of the impeller. The concavities forming the first group are arranged in concentric circles with respect to the rotational axis of the impeller. A second group of concavities is formed in an upper surface of the impeller. The concavities forming the second group are arranged in concentric circles with respect to the rotational axis of the impeller. A first groove is formed in a first inner surface of the casing. The first groove extends from an upstream end to a downstream end in an area that faces the first group of concavities. A second groove is formed in a second inner surface of the casing. The second groove extends from an upstream end to a downstream end in an area that faces the second group of concavities. An intake hole is formed in the casing. The intake hole passes from the exterior of the casing to the upstream end of the first groove. A discharge hole is formed in the casing. The discharge hole passes from the exterior of the casing to the downstream end of the second groove. At least one seal portion is disposed on at least one of the first inner surface, the second inner surface, the lower surface and the upper surface. The seal portion comprises one layer or a plurality of layers of thin film.

In this fuel pump, the seal portion that seals leakage of the fuel comprises one layer or a plurality of thin films. The formation of a thin film is easier and processing accuracy is higher than in the case of shaping by mechanical processing such as cutting. Thus, even if a seal portion has a complex shape, the seal portion can be manufactured at a low cost by using a thin film. Furthermore, a seal portion using a thin film has high accuracy. As a result, both the reduction in fuel leakage and the reduction in sliding resistance can be realized at a low manufacturing cost and with good stability.

Other objects, features and advantages of the present teachings will be readily understood after reading the following detailed description together with the accompanying drawings and claims. The additional features and aspects disclosed herein may be utilized singularly or, in combination with the above-described aspect and features.

DESCRIPTION OF THE PREFERRED EMBODIMENTS

Preferred embodiments of the present teaching will be described below.

(Feature 1)

A seal layer is formed from one thin film.

(Feature 2)

A seal layer is formed from two or more laminated thin films, and the cross section of the seal layer in the laminated portion has a step-like shape.

Embodiment 1

Figure 1:
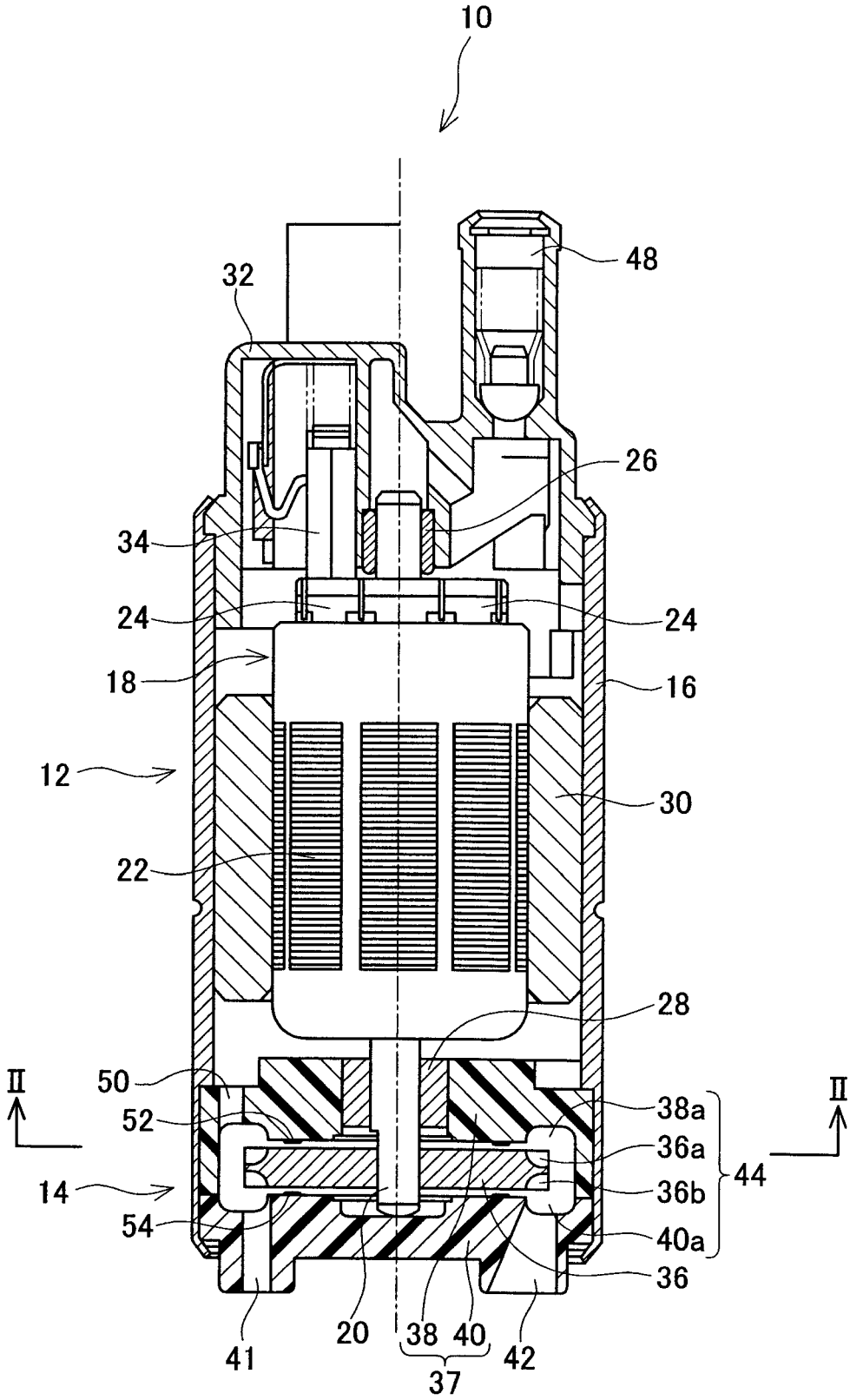
FIG. 1 is a vertical sectional view of the fuel pump of the first embodiment.

A first embodiment of the present teachings will be explained below. A fuel pump of the present embodiment is a fuel pump for an automobile. The fuel pump is disposed within a fuel tank and serves to supply fuel to the automobile engine. As shown in FIG. 1, a fuel pump 10 comprises a motor unit 12 and a pump unit 14 accommodated in a housing 16. The motor unit 12 has a rotor 18. The rotor 18 has a shaft 20, a laminated iron core 22 that is fixed to the shaft 20, a coil (not shown in the figure) that is wound about the laminated iron core 22, and a commutator 24 connected to the ends of the coil. The shaft 20 is supported by bearings 26, 28 so that it can rotate with respect to the housing 16. A permanent magnet 30 is fixed inside the housing 16 so as to surround the rotor 18. Terminals (not shown in the figure) are provided at a top cover 32 attached to the upper portion of the housing 16. The terminals are electrically connected to the rotor 18. When electric current is supplied to the coil via a brush 34 and the commutator 24, the rotor 18 and the shaft 20 rotate.

The pump unit 14 is accommodated in the lower portion of the housing 16. The pump unit 14 comprises a substantially disk-shaped impeller 36. A group of concavities 36*a* is provided in the upper surface of the impeller 36. The concavities 36*a* are arranged side by side at the outer peripheral edge of the impeller 36. A group of concavities 36*b* are provided in the lower surface of the impeller 36. The concavities 36*b* is arranged side by side at the outer peripheral edge of the impeller 36. A through hole is provided in the center of the impeller 36. The shaft 20 fits into the through hole of the impeller 36. Therefore, when the shaft 20 rotates, the impeller 36 also rotates.

Figure 2:
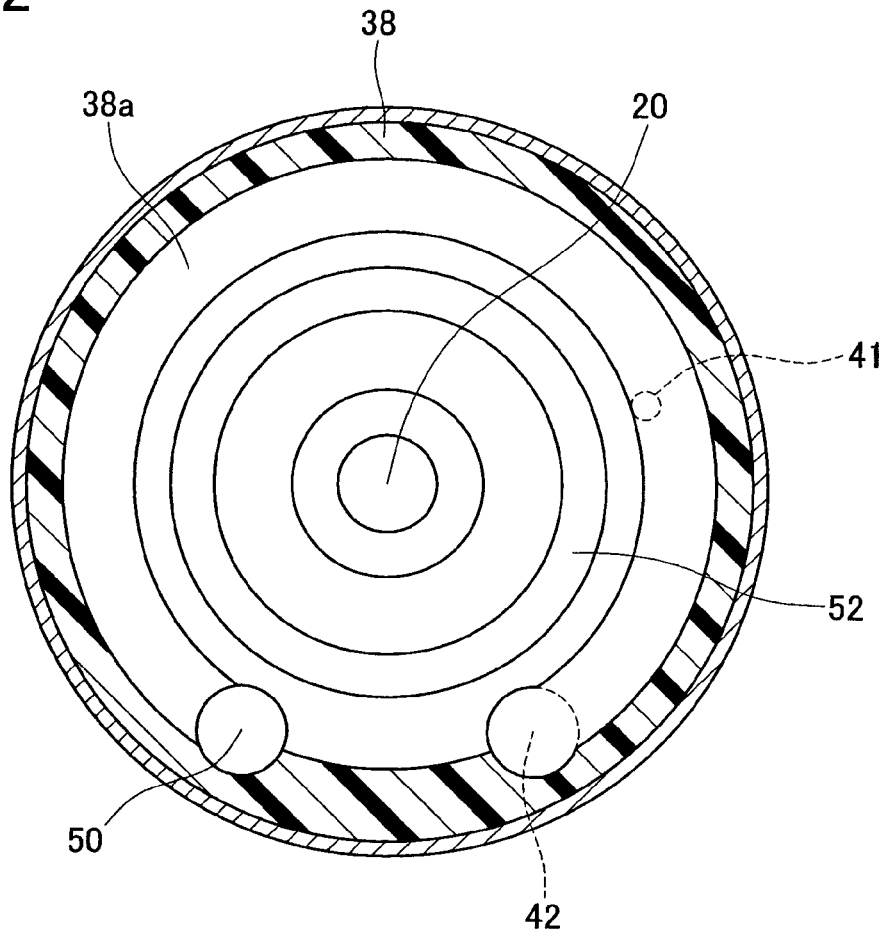
FIG. 2 is a cross sectional view along the II-II line in FIG. 1.

The casing 37 that accommodates the impeller 36 is composed of a pump cover 38 and a pump body 40. In the pump cover 38, a groove 38*a*, having a width almost twice as large as the width of the group of concavities 36*a* in the radial direction, is formed in the area that faces the outer peripheral edge of the impeller 36. As shown in FIG. 2, the groove 38*a* is formed to have an almost C-like shape extending from an upstream end to a downstream end along the rotation direction of the impeller 36. A discharge hole 50 passing from the downstream end of the groove 38*a* to the upper surface of the pump cover 38 is formed in the pump cover 38. The discharge hole 50 links the interior and exterior (inner space of the motor unit 12) of the casing 37.

As shown in FIG. 1, a groove 40*a*, having a width almost twice as large as the width of the group of concavities 36*b* in the radial direction, is formed in the pump body 40 in the area that faces the outer peripheral edge of the impeller 36. Similarly to the groove 38*a*, the groove 40*a* is formed to have an almost C-like shape extending from an upstream end to a downstream end along the rotation direction of the impeller 36. An intake hole 42 passing from the lower surface of the pump body 40 to the upstream end of the groove 40*a* is formed in the pump body 40. The intake hole 42 links the interior of the casing 37 with the exterior (exterior of the fuel pump). Furthermore, a vapor jet 41 is formed in the pump body 40. The vapor jet 41 discharges vapor generated inside the groove 40*a* to the outside of the pump. The groups of concavities 36*a* and 36*b*, groove 38*a*, and groove 40*a* form a pump channel 44 so as to cover the outer peripheral edge of the impeller 36.

When the impeller 36 rotates inside the casing 37, fuel is drawn into the pump channel 44 via the intake hole 42. While the fuel flows in the pump channel 44, the fuel pressure is increased. The pressurized fuel is discharged out from the discharge hole 50 toward the motor unit 12. The discharged fuel passes through the motor unit 12 and is discharged out from a discharge port 48 formed in the top cover 32.

Figure 3:
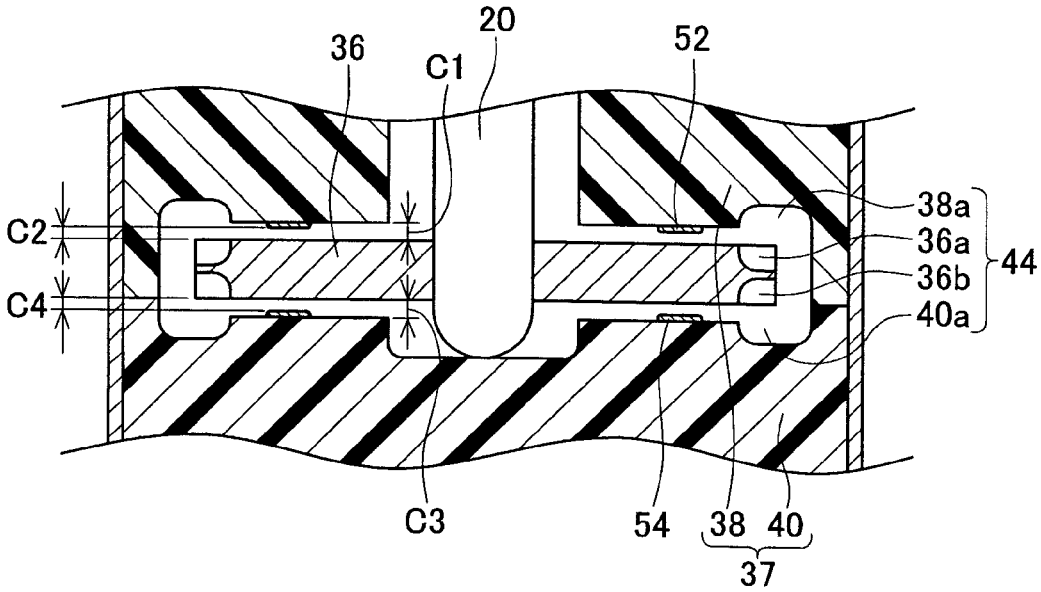
FIG. 3 is an enlarged view of the main portion of the fuel pump of the first embodiment.

As shown in FIG. 2 and FIG. 3, a seal layer 52 is formed on a surface (referred to hereinafter as "inner surface") of the pump cover 38 that faces the upper surface of the impeller 36. The seal layer 52 is convex toward the impeller 36. The seal layer 52 is, for example, a thin film with a thickness of 1 to 200 μm made from a synthetic resin such as a phenolic resin, an epoxy resin, or a polyamidoimide resin. The seal layer 52 can be formed using various well-known methods (e.g., screen printing, ink jet printing, sheet bonding) for forming thin films. For example, a thin film is disposed by screen printing on the pump cover 38 and then the thin film is fixed to the pump cover 38 by curing (i.e., drying, heat treatment, photo-curing, etc.). As a result, a thin film (i.e., a seal layer) can be formed on the inner surface of the casing 37. The seal layer 52 has a ring shape. The outer diameter of the seal layer 52 is slightly less than the inner diameter of the groove 38*a*, and the inner diameter of the seal layer 52 is almost intermediate between the outer diameter of the shaft 20 and the inner diameter of the groove 38*a*. The seal layer 52 is disposed to be concentric with the shaft 20 on the inner side of the groove 38*a*. A very small clearance C1 (see FIG. 3) is formed between the pump cover 38 and the impeller 36 in an area where the seal layer 52 is not formed. The thickness of the seal layer 52 is less than the clearance C1. A very small clearance C2 that is less than the clearance C1 is formed between the seal layer 52 and the impeller 36.

As shown in FIG. 3, a seal layer 54 is also formed on a surface of the pump body 40 that faces the lower surface of the impeller 36. The seal layer 54 is also a thin film with a thickness of 1 to 200 μm made from a synthetic resin such as a phenolic resin, an epoxy resin, or a polyamidoimide resin. The seal layer 54 is formed by the same method as the seal layer 52. The seal layer 54 has a ring shape similar to the seal layer 52 and the shape thereof is almost identical to that of the seal layer 52. The seal layer 54 is disposed to be concentric with the shaft 20 on the inner side of the groove 40*a*. A very small clearance C3 is formed between the pump body 40 and the impeller 36 in an area where the seal layer 54 is not formed. The thickness of the seal layer 54 is less than the clearance C3. A very small clearance C4 that is less than the clearance C3 is formed between the seal layer 54 and the impeller 36.

In the fuel pump of the present embodiment, seal layers 52, 54 are formed on the inner surfaces of the casing 37. The seal layers 52, 54 are formed directly inside the grooves 38*a*, 40*a*. As a result, the leakage of the fuel from the pump channel 44 into the clearances between the casing 37 and impeller 36 can be reduced. Furthermore, by forming the seal layers 52, 54, it is possible to ensure large clearances C1, C3 in the areas where the seal layers 52, 54 have not been formed. Therefore, sliding resistance can be also reduced, while reducing the leakage. The seal layers 52, 54 are formed by well-known thin film forming technology. Such method makes it possible to attain processing accuracy higher than that attained with shaping methods based on mechanical processing such as cutting. Therefore, the occurrence of variation in product performance can be inhibited. In addition, because the processing operations in thin film formation are simpler than those of cutting, the manufacturing cost can be reduced.

Embodiment 2

A second embodiment of the present teachings will be explained below. The fuel pump of the second embodiment is a partial modification of the fuel pump of the first embodiment. Accordingly, only the difference between the fuel pump of this embodiment and that of the first embodiment will be explained to avoid redundant explanation. Furthermore, components that are common for the fuel pump of the second embodiment and the fuel pump of the first embodiment will be denoted by similar reference symbols. The same is true for the below-described third to eleventh embodiments.

Figure 4:
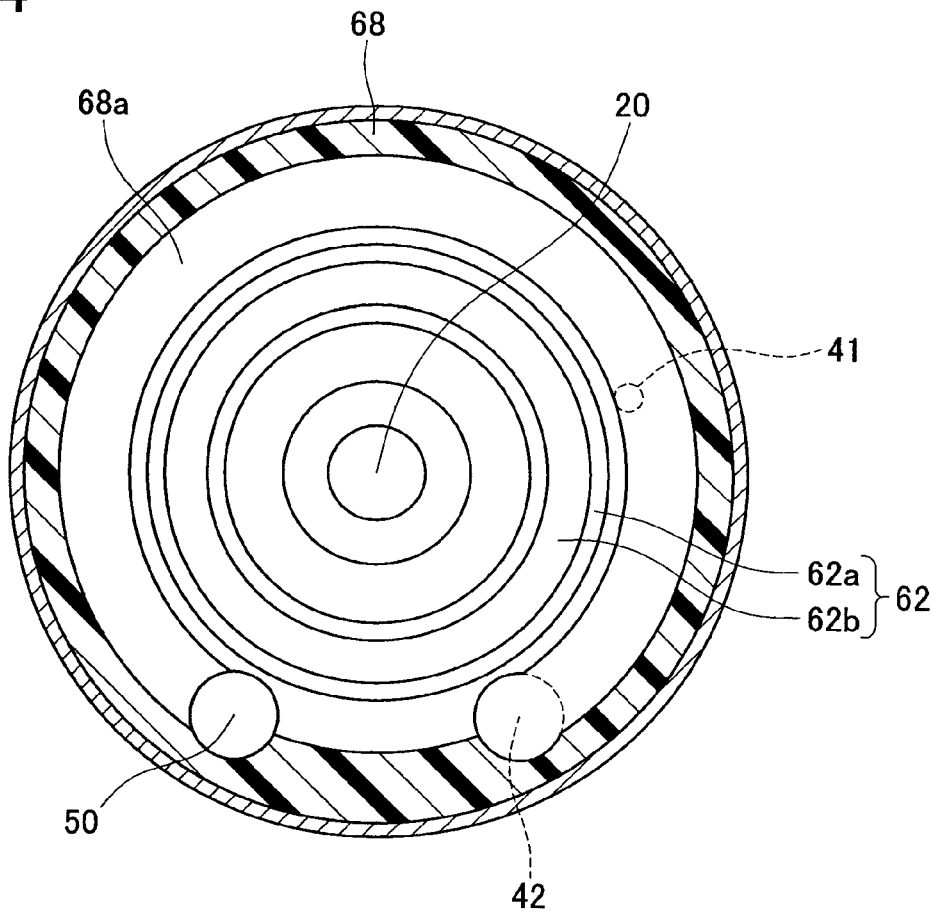
FIG. 4 is a drawing, which corresponds to the cross sectional view along the II-II line of FIG. 1, of the second embodiment.
Figure 5:
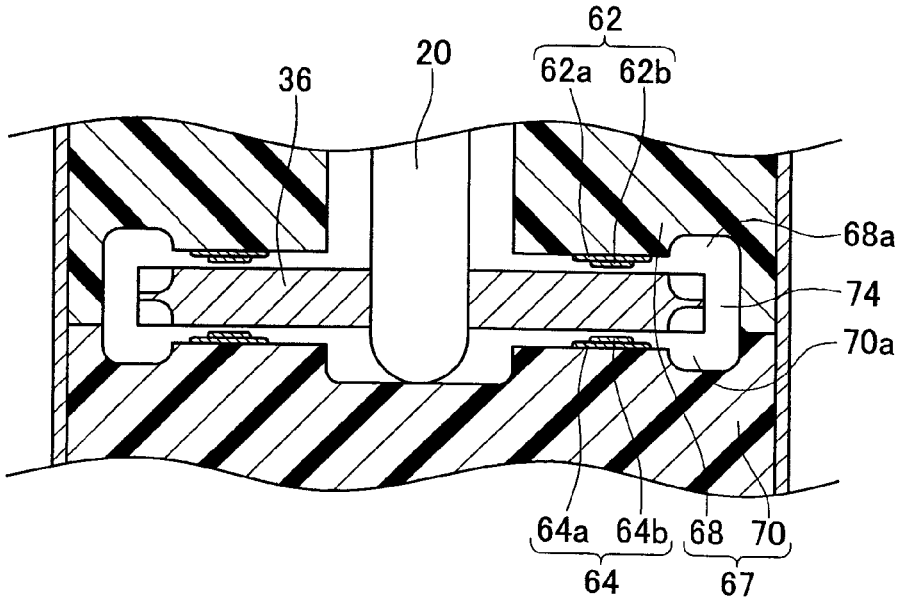
FIG. 5 is an enlarged view of the main portion of the fuel pump of the second embodiment.

As shown in FIG. 4 and FIG. 5, a seal layer 62 is formed on a surface of a pump cover 68 that faces an upper surface of an impeller 36. Similarly to the first embodiment, the seal layer 62 is a thin film made from a synthetic resin. The seal layer 62 can be formed by the same method as used in the first embodiment. The seal layer 62 is formed by laminating a lower layer 62*a* and an upper layer 62*b*. A width of the lower layer 62*a* in the radial direction is larger than a width of the upper layer 62*b* in the radial direction. The seal layer 62 has a step-shaped cross section. A very small clearance is also formed between the seal layer 62 and the impeller 36.

As shown in FIG. 5, a seal layer 64 is also formed on a surface of an pump body 70 that faces a lower surface of the impeller 36. The seal layer 64 is a thin film with a thickness of 1 to 200 μm made from a synthetic resin. The seal layer 64 is formed by the same method as the seal layer 62. The seal layer 64 is also formed by laminating a lower layer 64*a* and an upper layer 64*b* and has a step-shaped cross section. A very small clearance is also formed between the seal layer 64 and the impeller 36.

In the fuel pump of the second embodiment, the seal layers 62, 64 are formed on the surfaces of casing 67. As a result, the fuel leakage from the pump channel 74 can be reduced. The cross section of the seal layers 62 and 64 has a step-like shape. The upper layers 62*b*, 64*b* on the side of the impeller 36 serve as seal portions. The width of the upper layers 62*b*, 64*b* is less than the width of the lower layers 62*a*, 64*a* on the side of the casing 67. Therefore, a large clearance can be ensured in the area outside the upper layers 62*b*, 64*b*. Therefore, sliding resistance can be effectively reduced, while reducing the fuel leakage. The seal layers 62, 64 are also formed by well-known thin film forming technology. Therefore, the seal layers 62, 64 can be shaped with good accuracy and at a low manufacturing cost despite a complex step-like shape.

Embodiment 3

Figure 6:
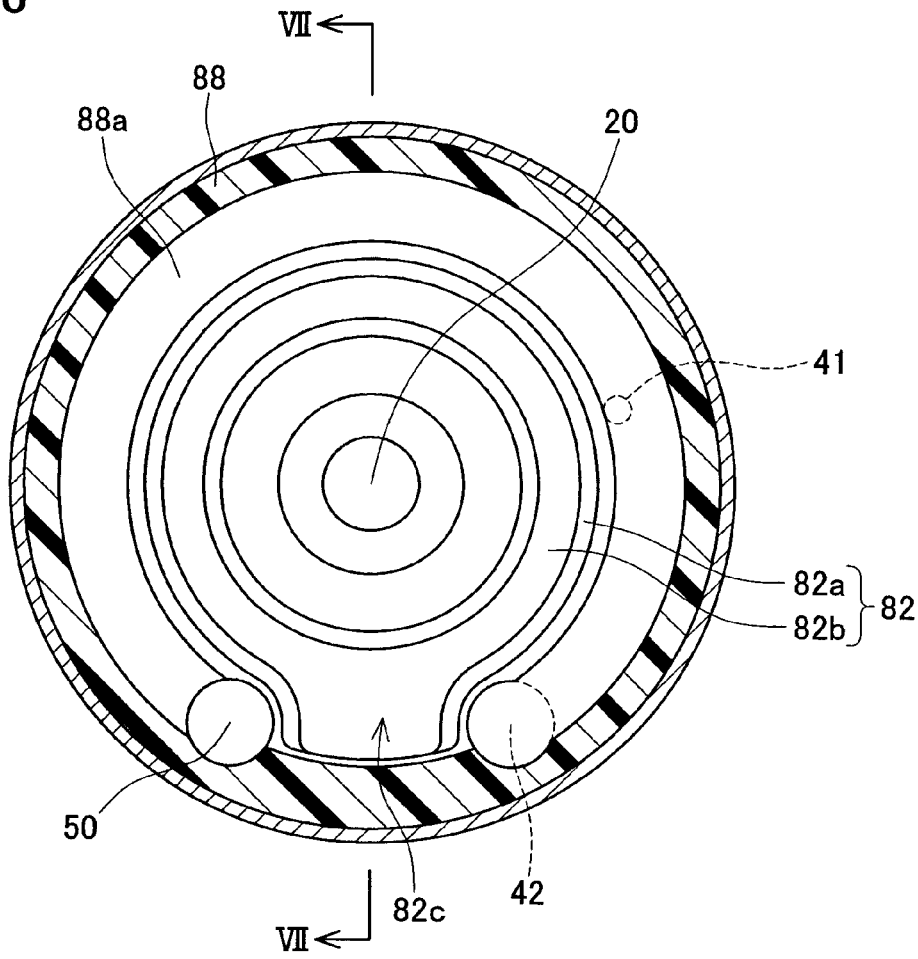
FIG. 6 is a drawing, which corresponds to the cross sectional view along the II-II line of FIG. 1, of the third embodiment.
Figure 7:
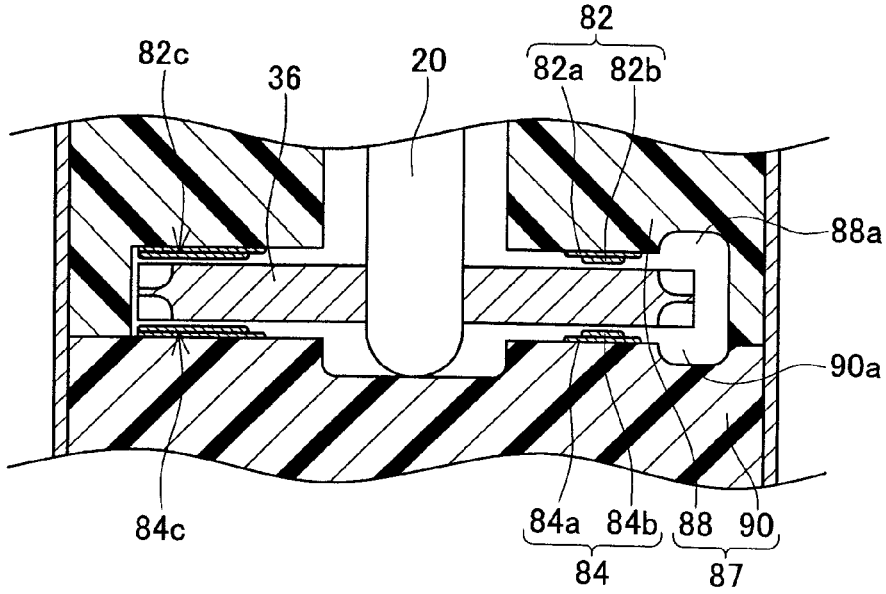
FIG. 7 is an enlarged view of the main portion of the fuel pump of the third embodiment.

A third embodiment of the present teachings will be explained below. As shown in FIG. 6 and FIG. 7, a seal layer 82 is formed on a surface of a pump cover 88 that faces an upper surface of an impeller 36. The seal layer 82 is a thin film made from a synthetic resin. The seal layer 82 is formed by the same method as in the above-described embodiments. The seal layer 82 is formed to have an almost ring shape and is formed between a discharge hole 50 and an upstream end of the groove 88*a* (i.e., an intake hole 42). Thus, the seal layer 82 is formed also in an area 82*c* located between the discharge hole 50 and the intake hole 42. The outer end of the seal layer 82 extends close to a circle to which a central line in the radial direction of a groove 88*a* can be extended in the circumferential direction. As shown in FIG. 7, the diameter of the circle serving as a central line in the radial direction of the groove 88*a* almost matches the outer diameter of the impeller 36. Further, the seal layer 82 comprises a lower layer 82*a* and an upper layer 82*b* and has a step-shaped cross section. A very small clearance is formed between the seal layer 82 and the upper surface of the impeller 36.

As shown in FIG. 7, a seal layer 84 is formed on a surface of an pump body 90 that faces a lower surface of the impeller 36. The seal layer 84 is a thin film made from a synthetic resin. The seal layer 84 is formed to have almost the same shape as the seal layer 82. Thus, similarly to the seal layer 82, the seal layer 84 is also formed to have an almost ring shape and is formed between a downstream end of the groove 90*a* (i.e., the discharge hole 50) and the intake hole 42. The seal layer 84 also comprises a lower layer 84*a* and an upper layer 84*b*. A very small clearance is formed between the seal layer 84 and the lower surface of the impeller 36.

Since the pressure of the fuel at the discharge hole 50 is highest and the pressure of the fuel at the intake hole 42 is lowest, the fuel leakages between the discharge hole 50 and the intake hole 42 is larger than the fuel leakage in other areas. In the fuel pump of the third embodiment, the seal layers 82, 84 are formed in the surfaces of the casing 87. Further, the seal layers 82, 84 reach the areas between the discharge hole 50 and the intake hole 42. As a result, sealing ability between the discharge hole 50 and the intake hole 42 is improved and the fuel leakage can be reduced even more effectively. Furthermore, the width of the upper layers 82*b*, 84*b* is less than the width of the lower layers 82*a*, 84*a*. Therefore, a large clearance can be ensured in the area outside the upper layers 82*b*, 84*b*. Therefore, sliding resistance can be effectively reduced.

Embodiment 4

Figure 8:
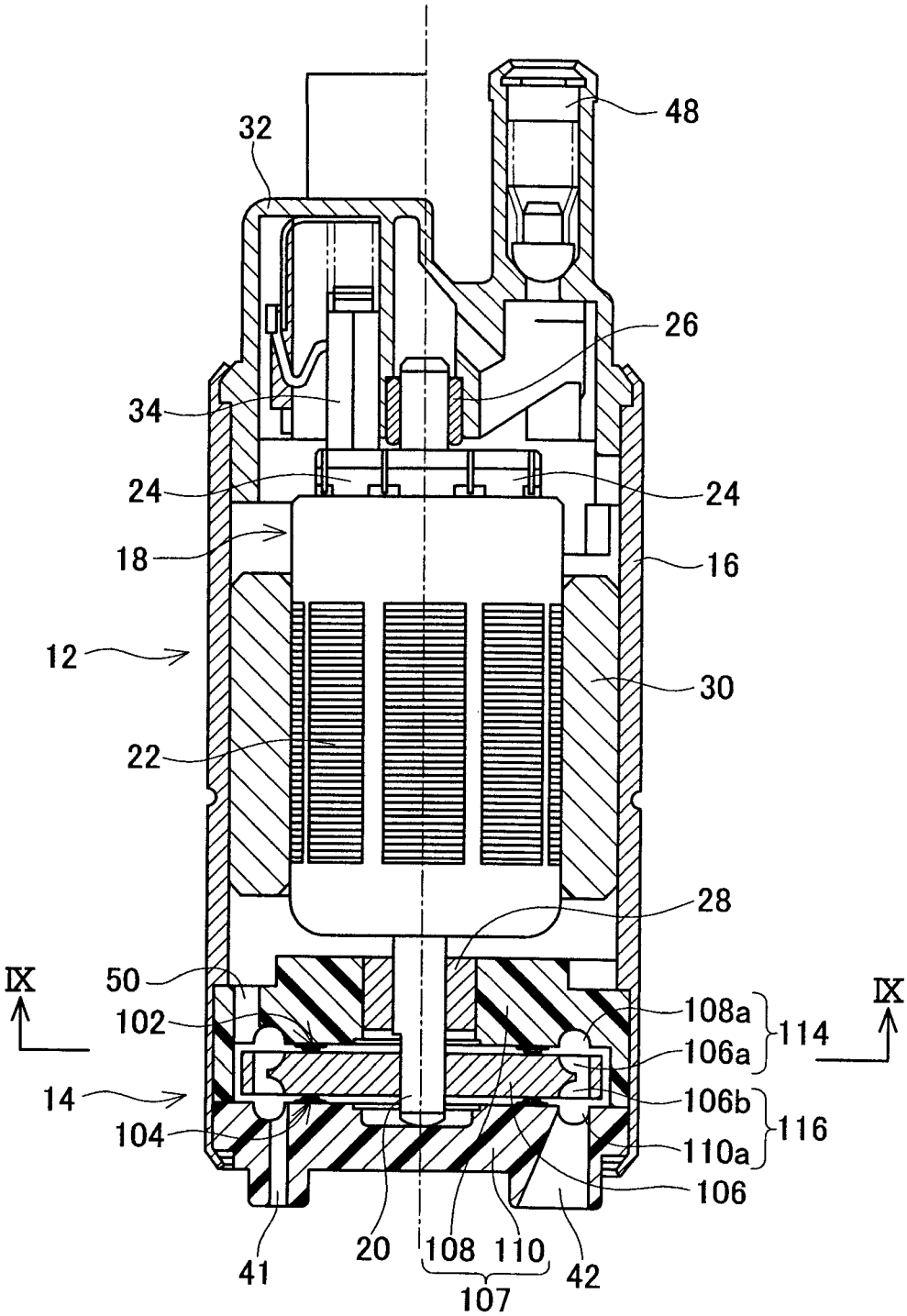
FIG. 8 is a vertical sectional view of the fuel pump of the fourth embodiment.

A fourth embodiment of the present teachings will be explained below. As shown in FIG. 8, a pump unit 14 comprises an impeller 106. A group of concavities 106*a* is provided in the vicinity of the outer peripheral edge of the upper surface of the impeller 106. A group of concavities 106*b* is provided in the vicinity of the outer peripheral edge of the lower surface of the impeller 106. Each of the groups of concavities 106*a*, 106*b* is formed in an area at a predetermined distance from the outer periphery of the impeller 106. Furthermore, each of the concavities 106*a* communicates with corresponding concavity 106*b* at the bottom portions thereof. A through hole that is engaged with a shaft 20 is provided in the center of the impeller 106.

Figure 9:
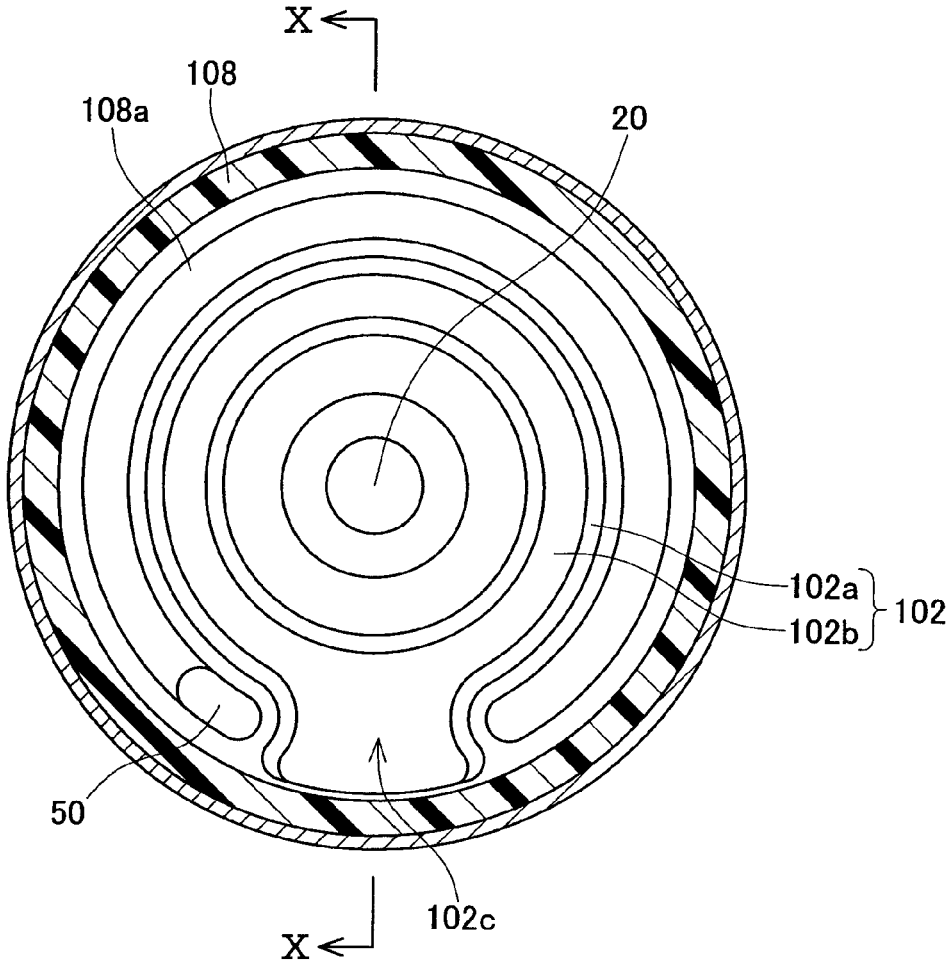
FIG. 9 is a cross sectional view along the IX-IX line in FIG. 8.

The casing 107 is composed of a pump cover 108 and an pump body 110. In the pump cover 108, a groove 108*a* is formed in an area that faces the group of concavities 106*a*. As shown in FIG. 9, the groove 108*a* extends from an upstream end to a downstream end along the rotation direction of the impeller 106. A discharge hole 50 is formed in the pump cover 108. The discharge hole 50 passes from the downstream end of the groove 108*a* to the upper surface of the pump cover 108. As shown in FIG. 8, a pump channel 114 is formed by the group of concavities 106*a* and the groove 108*a*. In the pump body 110, a groove 110*a* is formed in an area that faces the group of concavities 106*b*. Similarly to the groove 108*a*, the groove 110*a* extends from an upstream end to a downstream end along the rotation direction of the impeller 106. An intake hole 42 is formed in the pump body 110. The intake hole 42 passes from the lower surface of the pump body 110 to the upstream end of the groove 110*a*. Another pump channel 116 is formed by the group of concavities 106*b* and the groove 110*a*.

When the impeller 106 rotates, fuel is drawn into the pump channels 114 and 116. While the drawn fuel flows in the pump channels 114, 116, the fuel pressure is increased. The pressurized fuel is discharged out from the discharge hole 50 toward the motor unit 12.

Figure 10:
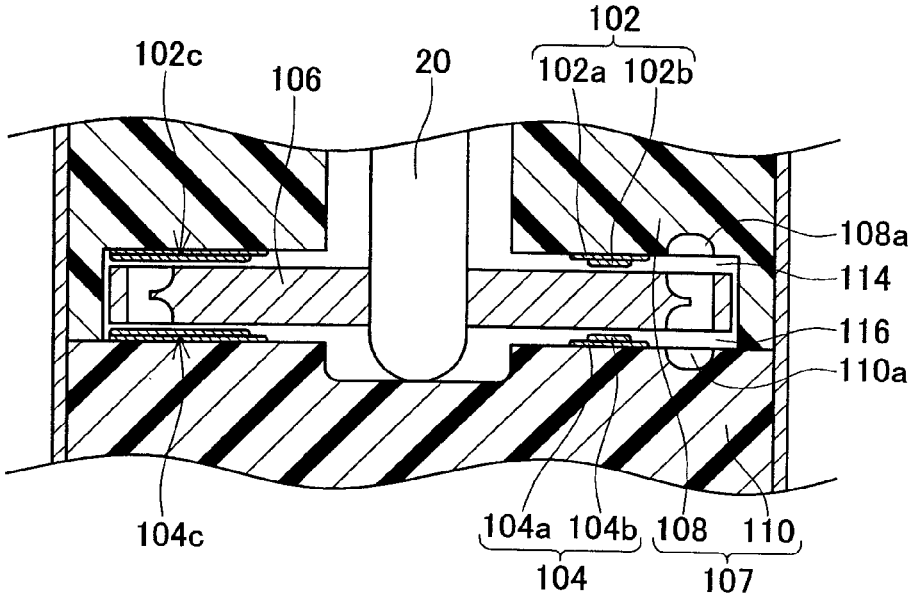
FIG. 10 is an enlarged view of the main portion of the fuel pump of the fourth embodiment.

As shown in FIGS. 9, 10, a seal layer 102 is formed in a surface of the pump cover 108 that faces the upper surface of the impeller 106. Similarly to the above mentioned embodiments, the seal layer 102 is a thin film made from a synthetic resin. The seal layer 102 is formed by the method similar to that of the above-described embodiments. The seal layer 102 has an almost ring shape and is formed between the discharge hole 50 and the upstream end of the groove 108*a*. The outer end of the seal layer 102 formed between the discharge hole 50 and the upstream end of the groove 108*a* extends beyond the outside of a circle to which the outer peripheral edge of the groove 108*a* can be extended. Thus, the outer end of the seal layer 102 extends to about the outer periphery of the impeller 106 (see FIG. 10). The seal layer 102 comprises a lower layer 102*a* and an upper layer 102*b*. A very small clearance is formed between the seal layer 102 and the impeller 106.

As shown in FIG. 10, a seal layer 104 is also formed on a surface of the pump body 110 that faces the lower surface of the impeller 106. The seal layer 104 is also a thin film made from a synthetic resin. The seal layer 104 is formed in the same manner as the seal layer 102. The seal layer 104 is formed to have an almost ring shape and is formed between the downstream end of the groove 110*a* and the intake hole 42. As shown in FIG. 10, an outer end of the seal layer 104 formed between the downstream end of the groove 110*a* and the intake hole 42 almost matches the outer diameter of the impeller 106. The seal layer 104 also comprises a lower layer 104*a* and an upper layer 104*b*. A very small clearance is formed between the seal layer 104 and the lower surface of the impeller 106.

In the fuel pump of the fourth embodiment, the seal layers 102, 104 are formed between the upstream ends and downstream ends of the grooves 108*a*, 110*a*. As a result, sealing ability in the discharge hole 50 and intake hole 42 can be improved and the fuel leakage can be effectively reduced.

Embodiment 5

Figure 11:
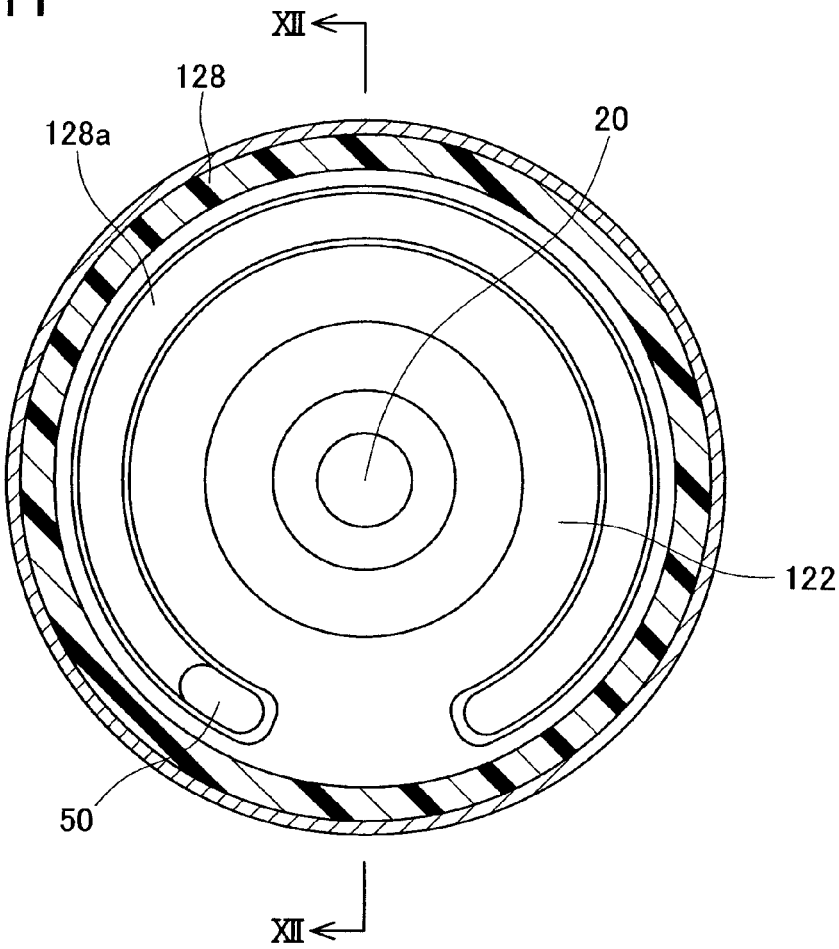
FIG. 11 is a drawing, which corresponds to the cross sectional view along the IX-IX line of FIG. 8, of the fifth embodiment.
Figure 12:
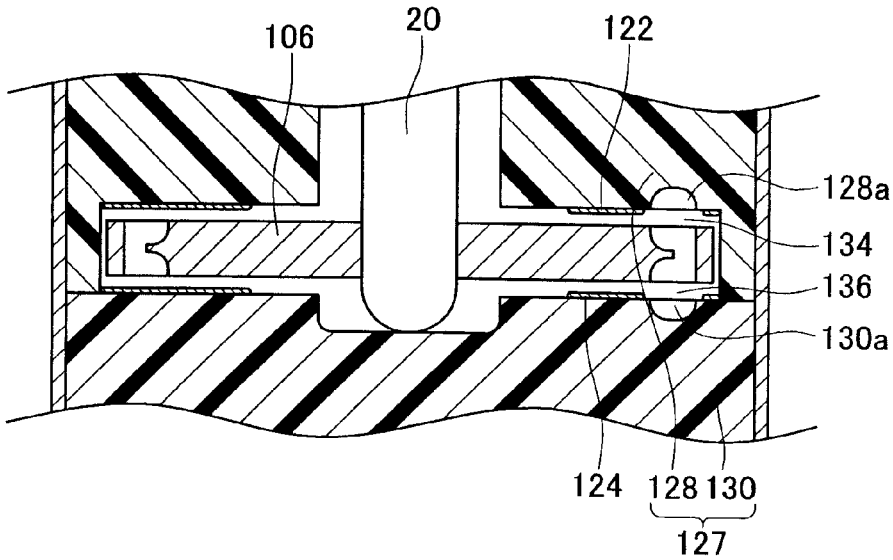
FIG. 12 is an enlarged view of the main portion of the fuel pump of the fifth embodiment.

A fifth embodiment of the present teachings will be explained below. As shown in FIG. 11 and FIG. 12, a seal layer 122 is formed in a surface of a pump cover 128 that faces an upper surface of an impeller 106. Similarly to the above mentioned embodiments, the seal layer 122 is a thin film made from a synthetic resin. In this embodiment, the seal layer 122 is formed in an area excluding the vicinity of a groove 128*a* and a through hole (i.e., shaft 20). Thus, the seal layer 122 is formed not only in the area inside the groove 128*a*, but also outside the groove. A very small clearance is formed between the seal layer 122 and the upper surface of the impeller 106.

As shown in FIG. 12, a seal layer 124 is formed on a surface of an pump body 130 that faces the lower surface of the impeller 106. The seal layer 124 is also a thin film made from a synthetic resin. Similarly to the seal layer 122, the seal layer 124 is formed in an area (inside and outside the groove 130*a*) excluding the vicinity of the groove 130*a* and the through hole (the shaft 20). A very small clearance is formed between the seal layer 124 and the impeller 106.

In the fuel pump of the fifth embodiment, the seal layers 122, 124 are formed around the respective grooves 128*a* and 130*a*. As a result, the fuel leakage from the pump channels 134, 136 can be reduced. In particular, because the seal layers 122, 124 are also formed on the outside of the grooves 128*a*, 130*a*, the fluid can be prevented from leaking to the clearance between the outer peripheral edges of the impeller 106 and the pump cover 128.

Embodiment 6

Figure 13:
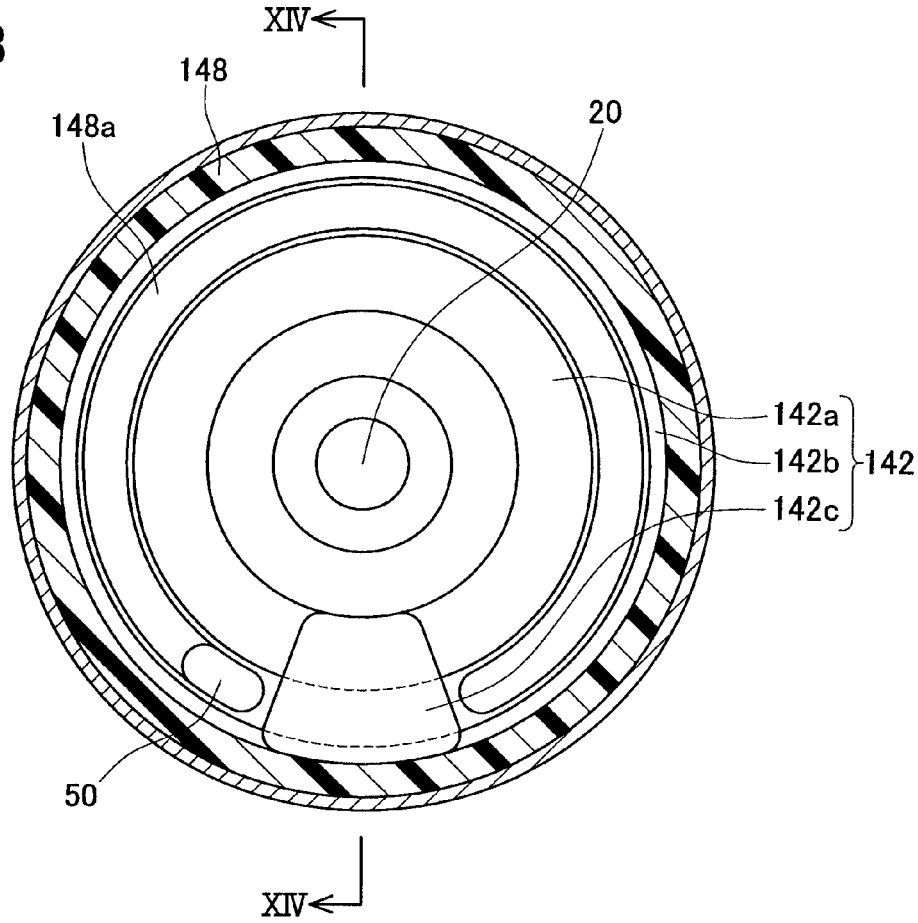
FIG. 13 is a drawing, which corresponds to the cross sectional view along the IX-IX line of FIG. 8, of the sixth embodiment.
Figure 14:
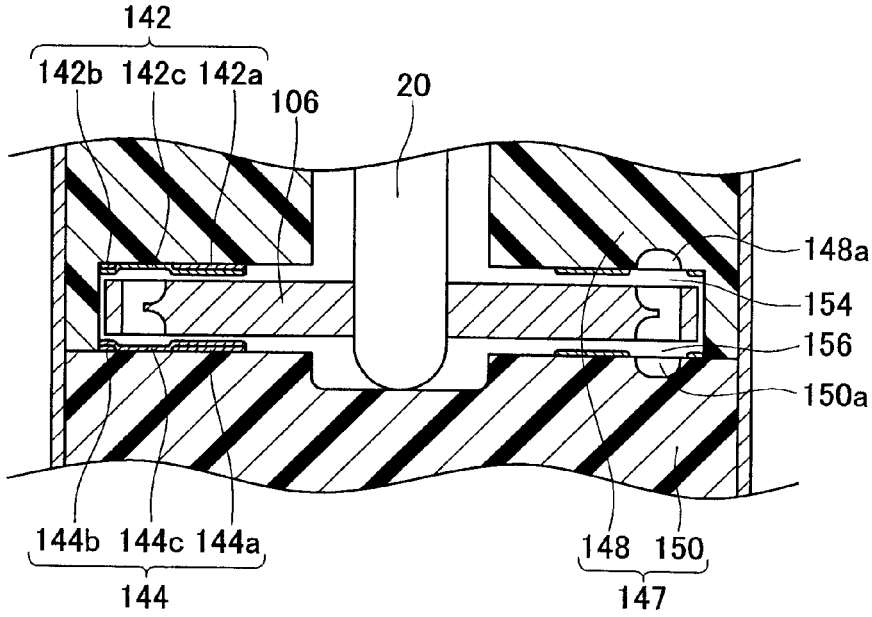
FIG. 14 is an enlarged view of the main portion of the fuel pump of the sixth embodiment.

A sixth embodiment of the present teachings will be explained below. As shown in FIGS. 13 and 14, a seal layer 142 is formed on a surface of a pump cover 148 that faces an upper surface of an impeller 106. The seal layer 142 is formed of three thin films 142*a*, 142*b*, 142*c* made from a synthetic resin. The thin film 142*a* has a ring shape and is disposed concentrically with a shaft 20 inside a groove 148*a*. The thin film 142*b* has a ring shape and is disposed concentrically with the shaft 20 outside the groove 148*a*. The thin film 142*c* is formed to have an almost trapezoidal shape. An end portion on the inner side of the thin film 142*c* is in the form of a circular arc that follows the inner peripheral edge of the thin film 142*a*, and the end portion on the outer side of the thin film 142*c* is in the form of a circular arc that follows the outer peripheral edge of the thin film 142*b*. The thin film 142*c* is disposed between a discharge port 50 and the upstream end of the groove 148*a*. In the seal layer 142, the thin film 142*c* is formed by lamination on the thin film 142*a* and the thin film 142*b*.

As shown in FIG. 14, a seal layer 144 is formed on a surface of an pump body 150 that faces the lower surface of the impeller 106. The seal layer 144 is also formed of three thin films 144*a*, 144*b*, 144*c*. The shape and arrangement of thin films 144*a*, 144*b*, 144*c* are similar to the shape and arrangement of thin films 142*a*, 142*b*, 142*c*, respectively.

In the fuel pump of the sixth embodiment, the seal layers 142, 144 are formed around the respective grooves 148*a*, 150*a* and in the area between the upstream end and downstream end of grooves 148*a*, 150*a*. As a result, the fuel leakage from pump channels 154, 156 can be reduced. Furthermore, the seal layers 142, 144 are formed of three thin films (142*a*, 142*b*, 142*c*), (144*a*, 144*b*, 144*c*), respectively. These thin films (142*a*, 142*b*, 142*c*), (144*a*, 144*b*, 144*c*) have a simple shape and may be disposed in respective adequate locations. Therefore, the seal layer of a complex shape can be easily formed with good accuracy and at a low cost. If necessary, the locations in which the thin films are disposed and the number of laminated thin films can be changed. Therefore, the degree of freedom in designing the clearance between the casing 147 and the impeller 106 can be increased.

Embodiment 7

Figure 15:
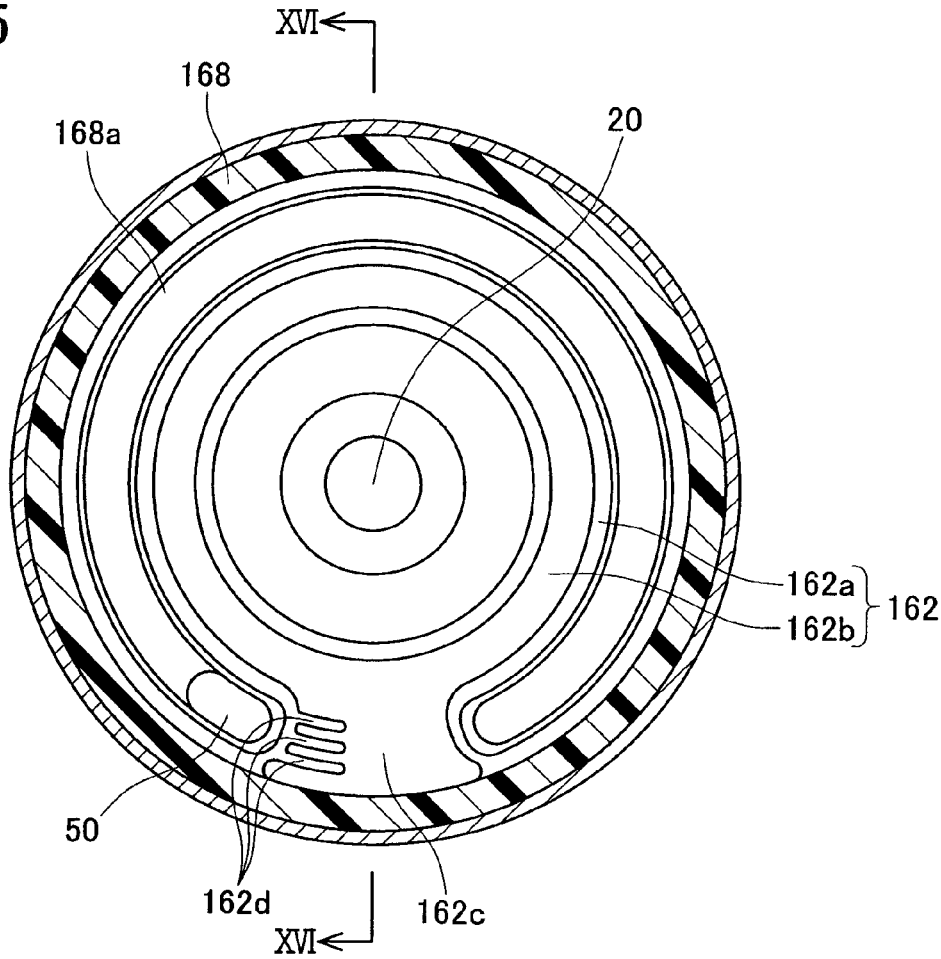
FIG. 15 is a drawing, which corresponds to the cross sectional view along the IX-IX line of FIG. 8, of the seventh embodiment.
Figure 16:
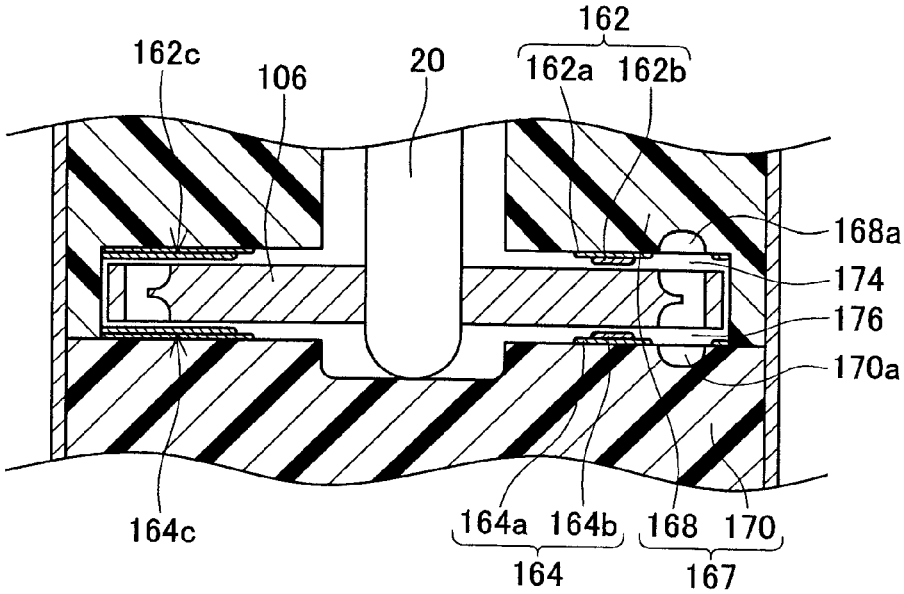
FIG. 16 is an enlarged view of the main portion of the fuel pump of the seventh embodiment.

A seventh embodiment of the present teachings will be explained below. As shown in FIGS. 15, 16, a seal layer 162 is formed on a surface of a pump cover 168 that faces an upper surface of an impeller 106. The seal layer 162 is formed of two thin films 162*a*, 162*b* made from a synthetic resin. The thin film 162*a* is disposed in a region except the vicinity of a groove 168*a* and a through hole (a shaft 20). The thin film 162*b* has an almost ring shape and is disposed in an area inside the groove 168*a* and also in an area 162*c* between the upstream end and downstream end (i.e., discharge hole 50) of the groove 168*a*. The outer end of the thin film 162*b* disposed in the area 162*c* extends to the outside of the circle to which the outer peripheral edge of the groove 168*a* can be extended and approximately matches the outer diameter of the impeller 106. In the thin film 162*b* disposed in the area 162*c*, there are three notches 162*d* extending in the circumferential direction from the end portion of the thin film on the side of the discharge hole 50. The length of the notches 162*d* is about one third of the distance between the discharge hole 50 and the upstream end of the groove 168*a*. The thin film 162*b* is laminated on the thin film 162*a*.

As shown in FIG. 16, a seal layer 164 is formed on a surface of an pump body 170 that faces a lower surface of the impeller 106. The seal layer 164 is formed of two thin films 164*a*, 164*b*. The shape and arrangement of thin films 164*a*, 164*b* are almost identical to the shape and arrangement of thin films 162*a*, 162*b*, respectively. Thus, the thin film 164*a* is disposed in a region except the vicinity of a groove 170*a* and a shaft 20. The thin film 164*b* is formed to have an almost ring shape and is disposed in an area inside the groove 170*a* and also in an area between the upstream end (intake hole) and the downstream end of the groove 170*a*. The outer end of the thin film 164*b* disposed between the upstream end and downstream end of the groove 170*a* approximately matches the outer diameter of the impeller 106. In the thin film 164*b* disposed between the upstream end and downstream end of the groove 170*a*, there are three notches (not shown in the figure) extending in the circumferential direction from the end portion of the thin film on the side of the intake hole. The thin film 164*b* is laminated on the thin film 164*a*.

In the fuel pump of the seventh embodiment, the seal layers 162, 164 are formed around the respective grooves 168*a*, 170*a* and in the area between the upstream end and downstream end of grooves 168*a*, 170*a*. As a result, the fuel leakage from pump channels 174, 176 can be reduced. Further, the seal layers 162, 164 are formed of two thin films (162*a*, 162*b*), (164*a*, 164*b*), respectively. In the thin films 162*b*, 164*b* that are laminated as top film, notches are formed in the vicinity of the discharge hole 50 or intake hole 42. When viewed as a longitudinal cross-section along the radial direction of the impeller, cross-sectional area of the clearances between the thin films 162*b*, 164*b* and the casing 167 changes gradually in the vicinity of the discharge hole 50 or intake hole 42. As a result, periodic pressure fluctuations caused by rotation of the impeller 106 can be relaxed and noise generation can be reduced.

Embodiment 8

Figure 17:
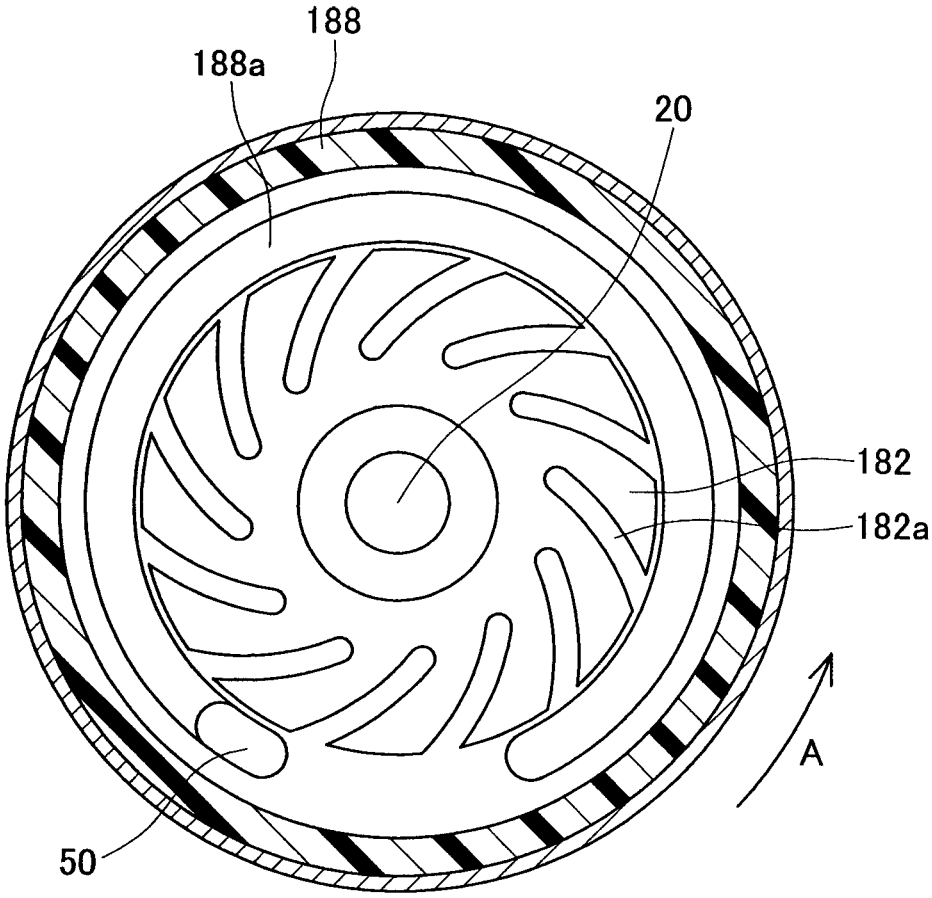
FIG. 17 is a drawing, which corresponds to the cross sectional view along the IX-IX line of FIG. 8, of the eighth embodiment.

An eighth embodiment of the present teachings will be explained below. As shown in FIG. 17, a seal layer 182 is formed on a surface of a pump cover 188 that faces an upper surface of an impeller 106 (see FIG. 8). The seal layer 182 is formed of a thin film made from a synthetic resin. The seal layer 182 has an almost ring shape and is disposed on the inner side from a groove 188*a*. A group of notches 182*a* is formed in the seal layer 182. The notches 182*a* are substantially same to each other in shape and size and are disposed equidistantly along the outer periphery of the seal layer 182. Each notch 182*a* extends as a curve (spirally) from the outer peripheral side of the seal layer 182 toward the center (closed end). An end portion of the notch 182*a* on the center side (i.e., a closed end of the notch 182*a*) is shifted in the rotation direction (i.e., the direction of arrow A) of the impeller 106 with respect to the end portion on the outer periphery side (i.e., an open end of the notch 182*a*). In other words, the end portion of the notch 182*a* on the center side is located at a position forward of a position of the end portion of the notch 182*a* on the outer periphery side in the rotation direction of the impeller 106. A very small clearance is formed between the seal layer 182 and the impeller 106. A seal layer (not shown in the figure) similar to the seal layer 182 is formed on a surface of the pump body that faces a lower surface of the impeller 106.

In the fuel pump of the eighth embodiment, a group of spiral notches 182*a* is formed in the seal layer 182 of the pump cover 188, and a similar group of notches is formed in the seal layer of the pump body. As a result, respective groups of spiral grooves (these grooves will be hereinafter referred to as spiral grooves) are formed in the surface of the pump cover 188 that faces the impeller 106 and in the surface of the pump body that faces the impeller 106. The end portion on the center side of the spiral groove is shifted with respect to the end portion on the outer periphery side in the rotation direction of the impeller 106. As a result, when the impeller 106 rotates, the fuel in the clearance between the impeller 106 and the casing is drawn into the spiral grooves and flows from the end portion on the outer periphery side of the spiral groove to the end portion on the center side of the spiral groove. When the fuel drawn into the spiral grooves flows from the outer periphery side toward the center, the pressure of the fuel in the grooves acts upon the upper and lower surfaces of the impeller 106, and the impeller 106 is held between the pump cover 188 and the pump body. Thus, even if a clearance between the casing and the impeller 106 is decreased, increasing the sliding resistance is prevented. Therefore, both the reduction in the fuel leakage and the reduction in sliding resistance can be realized. Further, because the seal layer is formed by a well-known thin-film forming technology, a high processing accuracy can be obtained at a low cost. Therefore, a group of notches 182*a* can be formed with good accuracy at a low cost.

Embodiment 9

Figure 18:
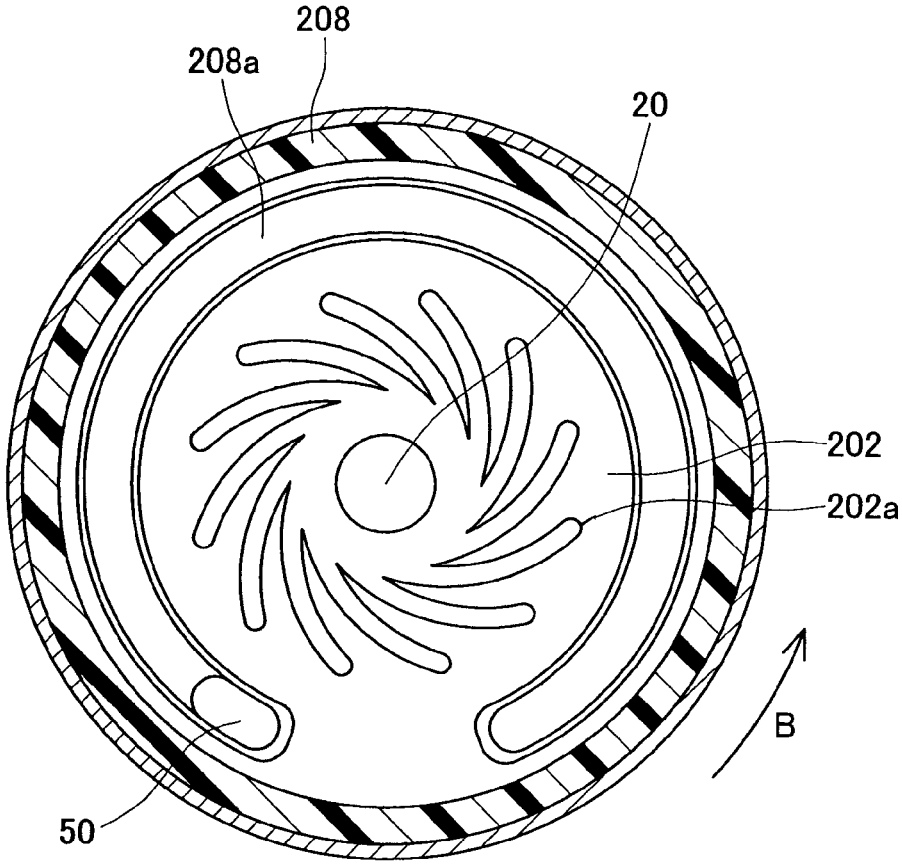
FIG. 18 is a drawing, which corresponds to the cross sectional view along the IX-IX line of FIG. 8, of the ninth embodiment.

A ninth embodiment of the present teachings will be explained below. As shown in FIG. 18, a seal layer 202 is formed in a surface of a pump cover 208 that faces an upper surface of an impeller 106 (see FIG. 8). The seal layer 202 is formed of a thin film made from a synthetic. The seal layer 202 is formed in an area except the vicinity of a groove 208*a* and a shaft 20. A group of notches 202*a* is formed in the seal layer 202. The notches 202*a* have substantially identical shape and size and are disposed between the outer diameter of the shaft 20 and the inner diameter of the groove 208*a*. Each notch 202*a* extends as a curve (spirally) from the center side of the seal layer 202 toward the outer periphery side. An end portion of the notch 202*a* on the outer periphery side is shifted in the rotation direction (arrow B) of the impeller 106 with respect to the end portion on the center side. In other words, the end portion of the notch 202*a* on the outer periphery side (i.e., closed end of the notch 202*a*) is located at a position forward of a position of the end portion of the notch 202*a* on the center side (i.e., open end of the notch 202*a*) in the rotation direction of the impeller 106. A very small clearance is formed between the seal layer 202 and the impeller 106. A seal layer (not shown in the figure) similar to the seal layer 202 is formed in a surface of the pump body that faces a lower surface of the impeller 106.

In the fuel pump of the ninth embodiment, group of spiral notches are formed in the seal layers of the pump cover 208 and pump body. As a result, when the impeller 106 rotates, the fuel in the clearance between the impeller 106 and the casing is drawn into the spiral grooves and flows from the end portion on the center side of the spiral groove to the end portion on the outer periphery side of the spiral groove. When the fuel inside the spiral grooves flows from the center side toward the outer periphery side, the pressure of the fuel in the spiral grooves acts upon the upper and lower surfaces of the impeller 106, and the impeller 106 is held between the pump cover 208 and the pump body. Because contact between the impeller 106 and the casing is prevented by the pressure of fuel flowing in the spiral grooves, the clearance between the casing and the impeller 106 can be reduced. Therefore, both the reduction in leak flow rate and the reduction in sliding resistance can be realized.

Embodiment 10

A tenth embodiment of the present teachings will be explained below.

Figure 19:
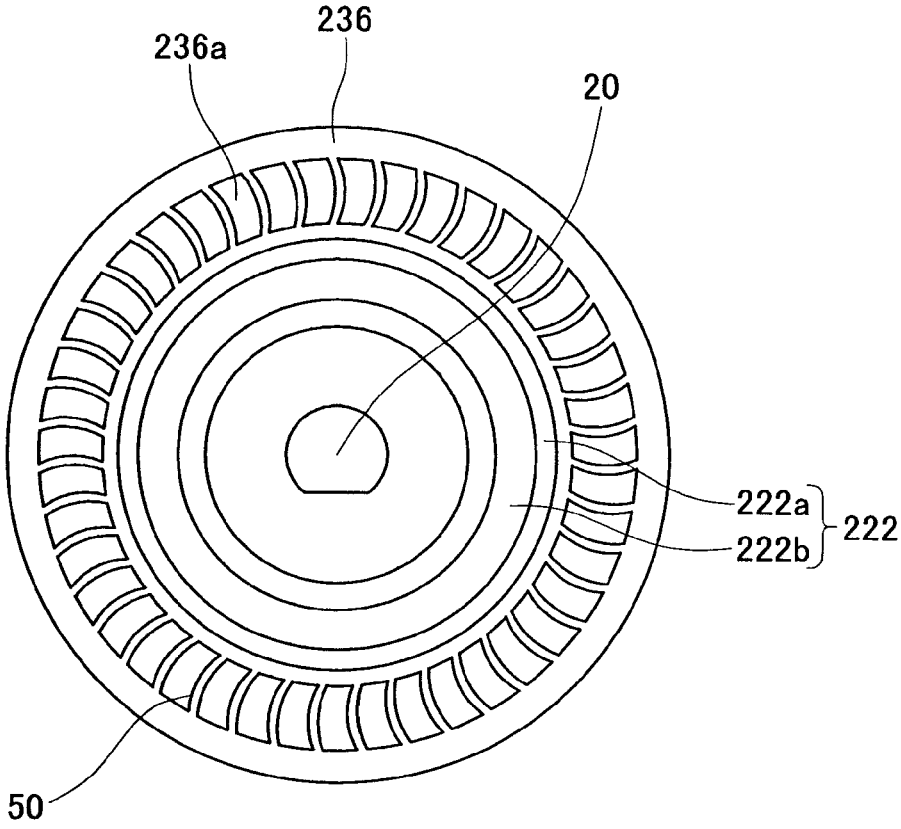
FIG. 19 is a plan view of the impeller of the tenth embodiment.

As shown in FIG. 19, a seal layer 222 is formed on an upper surface of an impeller 236 (see FIG. 8). The seal layer 222 is formed of two thin films 222*a*, 222*b* made from a synthetic resin. The thin film 222*a* has a ring shape, the outer diameter thereof is somewhat less than the inner diameter of the group of concavities 236*a*, and the inner diameter of the thin film 222*a* is about in the middle between the outer diameter of a shaft 20 and the inner diameter of the group of concavities 236*a*. The thin film 222*a* is disposed concentrically with the shaft 20. The thin film 222*b* also has a ring shape, the outer diameter thereof is less than the outer diameter of the thin film 222*a*, and the inner diameter is larger than the inner diameter of the thin film 222*a*. The thin film 222*b* is laminated on the thin film 222*a*. A seal layer (not shown in the figure) similar to the seal layer 222 is also formed on a lower surface of the impeller 236 (see FIG. 8).

In the fuel pump of the tenth embodiment, the seal layer 222 is formed on the upper surface of the impeller 236, and a seal layer similar to the seal layer 222 is also formed in the lower surface of the impeller 236. Therefore, the fuel leakage from the pump channel can be reduced. Furthermore, the seal layers are formed by a well-known thin film formation technology. As a result, they can be formed with high accuracy at a low cost. Because the seal layers can be formed with high accuracy, the clearance between the impeller and the casing can be decreased and pump efficiency can be increased.

Embodiment 11

Figure 20:
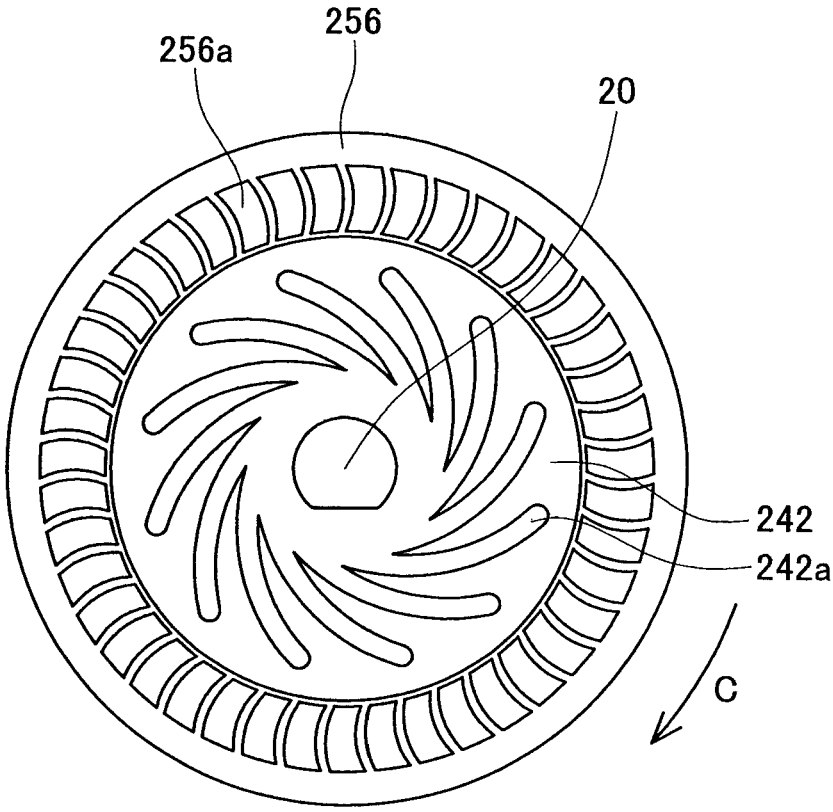
FIG. 20 is a plan view of the impeller of the eleventh embodiment.

An eleventh embodiment of the present teachings will be explained below. As shown in FIG. 20, a seal layer 242 is formed in a surface of an upper surface of an impeller 256 (see FIG. 8). The seal layer 242 is formed of a thin film made from a synthetic resin. The seal layer 242 has a ring shape and is disposed on the inner side of a group of concavities 256*a*. A group of notches 242*a* is formed in the seal layer 242. The notches 242*a* have substantially same shape. Each notch 242*a* extends as a curve (spirally) from the center side of the seal layer 242 toward the outer periphery side. An end portion of the notch 242*a* on the center side is shifted in the rotation direction (arrow C) of the impeller 256 with respect to the end portion on the outer periphery side. In other words, the end portion of the notch 242*a* on the center side (i.e., open end of the notch 242*a*) is located at a position forward of a position of the end portion on the outer periphery side (i.e., closed end of the notch 242*a*) in the rotation direction of the impeller 256. A seal layer (not shown in the figure) similar to the seal layer 242 is formed in a lower surface of the impeller 256 (see FIG. 8). It is noted that the end portion of the notch 242*a* on the outer periphery side may be located at a position forward of a position of the end portion on the center side in the rotation direction of the impeller 256.

In the fuel pump of the eleventh embodiment, since the seal layers are formed in the upper and lower surfaces of the impeller 256, the fuel leakage from the pump channel can be reduced. Furthermore, because groups of spiral notches are formed in these seal layers, when the impeller 256 rotates, the fuel in the clearance between the impeller 106 and the casing 107 is drawn into the spiral grooves and flows from the end portion on the center side of the spiral groove to the end portion on the outer periphery side of the spiral groove, and the pressure of the fuel in the spiral grooves acts upon the upper and lower surfaces of the impeller 256. As a result, the impeller 256 is held between the pump cover 108 and the pump body 110. Since contact between the casing 107 and the impeller 106 is prevented by the pressure of fuel flowing in the spiral grooves, the clearance between the casing 107 and the impeller 106 can be decreased. Therefore, both the reduction in fuel leakage and the reduction in sliding resistance can be realized.

In the fuel pumps of the above-described embodiments 1 to 11, the seal layers use a synthetic resin as a material for a thin film constituting the seal layer. However, the present teachings are not limited such configuration, For example, a material obtained by adding an additive to a synthetic resin may be also used as a material for the thin film. When graphite, PTFE (polytetrafluoroethylene (trade name: Teflon)), and molybdenum disulfide that increase sliding ability are used as the additive, sliding resistance can be reduced and wear of the seal layer can be inhibited. Furthermore, where an inorganic filler such as talc and silica is used as an additive to adjust viscosity, an appropriate viscosity can be obtained and operability can be improved.

Figure 21:
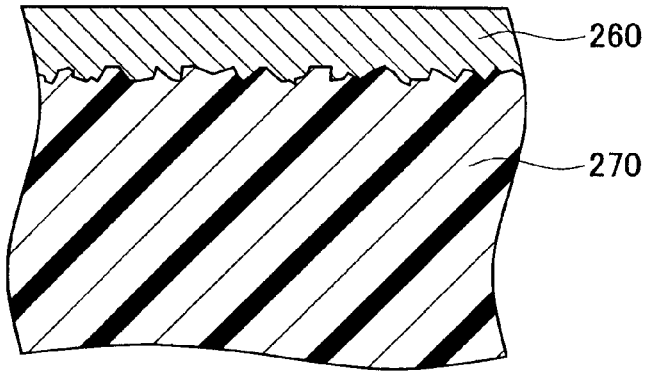
FIG. 21 is a vertical sectional view illustrating examples of the casing or impeller in the area where the seal layer is formed.

Furthermore, as shown in FIG. 21, before a thin film is formed on the surface of the casing or impeller, peaks and valleys may be formed on the surface of a base material (i.e., casing or impeller) 270. As a result, bonding strength between the thin film 260 of a seal layer and the base material 270 is increased by an anchor effect. Note that peaks and valleys on the surface of the base material 270 can be formed by etching.

Figure 22:
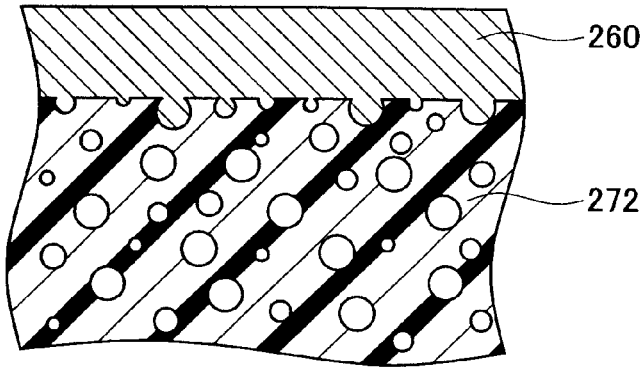
FIG. 22 is a vertical sectional view illustrating examples of the casing or impeller in the area where the seal layer is formed.

Alternatively, a porous material may be used as a base material 272, as shown in FIG. 22. As a result, because peaks and valleys are present on the surface of the base material 272, bonding of the thin film 260 of a seal layer and the base material 272 can be increased without processing the surface of the base material 272.

Figure 23:
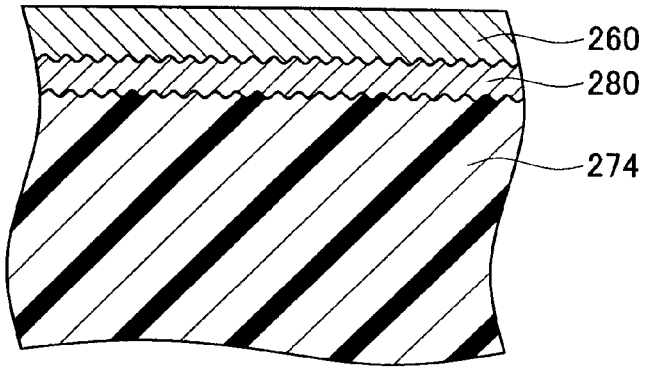
FIG. 23 is a vertical sectional view illustrating examples of the casing or impeller in the area where the seal layer is formed.

Furthermore, as shown in FIG. 23, an intermediate layer 280 composed of a material having affinity for both a base material 274 and the seal layer 260 may be provided between the seal layer 260 and the base material 274. For example, where the base material 274 is aluminum or a synthetic resin and the seal layer 260 is from a stainless steel foil, an epoxy resin and/or an acrylic resin can be used as a material of the intermediate layer 280. In this case, the epoxy resin and/or acrylic resin acts as an adhesive that can bond the seal layer 260 and the base material 274.

As described hereinabove, with the fuel pumps of embodiments 1 to 11, a seal layer is formed on the surface of a casing or an impeller by a thin film formation technology that enables accurate processing in an easy manner and at a low cost. As a result, two problems that have in a trade-off relationship, namely, the reduction in fuel leakage and the reduction in sliding resistance, can be resolved with good stability. Therefore, pump efficiency can be significantly improved.

Several preferred embodiments of the present teachings have been described above, but these embodiments are merely illustrating examples and do not limit the scope of the claims. Various alternatives and modifications to the above specific examples are included in the technology described in the scope of the patent claims.

Furthermore, the technological elements disclosed in the present specification and appended drawings have technical utility individually or in various combinations thereof and are not limited to the combinations described in the claims at the time of filing. Moreover, the art disclosed in the present specification and appended drawings achieve a plurality of objects simultaneously, and have technical utility by achieving one of these objects.

What is claimed is:

1. A fuel pump comprising:

a casing; and a substantially disk-shaped impeller rotatably disposed within the casing, wherein a first group of concavities is formed in a lower surface of the impeller, and concavities forming the first group are arranged in concentric circles with respect to a rotational axis of the impeller;

a second group of concavities is formed in an upper surface of the impeller, and concavities forming the second group are arranged in concentric circles with respect to a rotational axis of the impeller;

a first groove is formed in a first inner surface of the casing, the first groove extending from an upstream end to a downstream end in an area that faces the first group of concavities;

a second groove is formed in a second inner surface of the casing, the second groove extending from an upstream end to a downstream end in an area that faces the second group of concavities;

an intake hole is formed in the casing, the intake hole passing from the exterior of the casing to the upstream end of the first groove;

a discharge hole is formed in the casing, the discharge hole passing from the exterior of the casing to the downstream end of the second groove;

at least one seal portion is disposed on at least one of the first inner surface, the second inner surface, the lower surface and the upper surface, the seal portion comprising a plurality of layers of thin film, the plurality of layers of thin film formed by an identical material; and a clearance is formed between the seal portion and a portion facing the seal portion.

2. The fuel pump according to claim 1, wherein at least one seal portion is disposed on at least one of the first and second inner surfaces of the casing, and the seal portion is disposed along at least one of the first and second grooves.

3. The fuel pump according to claim 2, wherein the seal portion is disposed on the inner side of at least one of the first and second grooves, and the seal portion is substantially ring-shaped and concentric to at least one of the first and second grooves.

4. The fuel pump according to claim 3, wherein the seal portion comprises at least first and second ring-shaped thin film, an outer diameter of the first ring-shaped thin film is larger than that of the second ring-shaped thin film, an inner diameter of the first ring-shaped thin film is smaller than that of the second ring-shaped thin film, the second ring-shaped thin film is disposed on the first ring-shaped thin film.

5. The fuel pump according to claim 1, wherein at least one seal portion is disposed on the first inner surface of the casing, and the seal portion is disposed between the intake hole and the downstream end of the first groove.

6. The fuel pump according to claim 5, wherein the seal portion is further disposed on both the inner and outer sides of at least one of the first and second grooves; and an outer wall of the casing is disposed on an outer side of the seal portion disposed on the outer side of the at least one of the first and second grooves.

7. The fuel pump according to claim 5, wherein the groups of concavities are formed in an area at a predetermined distance from the outer periphery of the impeller, and the seal portion is further disposed on both the inner and outer sides of at least one of the first and second grooves; and an outer wall of the casing is disposed on an outer side of the seal portion disposed on the outer side of the at least one of the first and second grooves.

8. The fuel pump according to claim 5, wherein the groups of concavities are formed in an area at a predetermined distance from the outer periphery of the impeller, the seal portion comprises at least first, second, and third thin film, wherein the first thin film has a ring shape and is disposed on the inner side of the first groove, the second thin film has a ring shape and is disposed on the outer side of the first groove, the third thin film is disposed between the intake hole and the downstream end of the first groove, and wherein one end of the third thin film is connected to the first thin film, and the other end of the third film is connected to the second thin film, and an outer wall of the casing is disposed on an outer side of the seal portion disposed on the outer side of the at least one of the first and second grooves.

9. The fuel pump according to claim 5, wherein the seal portion between the intake hole and the downstream end of the first groove has at least one notch extending in the circumferential direction from the end of the seal portion on the side of the intake hole.

10. The fuel pump according to claim 1, wherein at least one seal portion is disposed on the second inner surface of the casing, and the seal portion is disposed between the upstream end of the second groove and the discharge hole.

11. The fuel pump according to claim 10, wherein the seal portion between the upstream end of the second groove and the discharge hole has at least one notch extending in the circumferential direction from the end of the seal portion on the side of the discharge hole.

12. The fuel pump according to claim 10, wherein the seal portion between the upstream end of the second groove and the discharge hole is arranged such that an area of a clearance between the lower surface of the seal portion and the upper surface of the impeller increases continuously toward the discharge hole.

13. The fuel pump according to claim 1, wherein a first seal portion is disposed on the first inner surface of the casing and disposed along the first groove, the first seal portion includes a plurality of first grooves defined therein, each first groove extends from an inner closed end to an outer open end in the radial direction of the impeller, and the inner closed end of the first groove is located at a position forward of a position of the outer open end of the first groove in the rotation direction of the impeller; and a second seal portion is disposed on the second inner surface of the casing and disposed along the second groove, the second seal portion includes a plurality of second grooves defined therein, each second groove extends from an inner closed end to an outer open end in the radial direction of the impeller, and the inner closed end of the second groove is located at a position forward of a position of the outer open end of the second groove in the rotation direction of the impeller.

14. The fuel pump according to claim 1, wherein a first seal portion is disposed on the first inner surface of the casing and disposed along the first groove, the first seal portion includes a plurality of first grooves defined therein, each first groove extends from an inner open end to an outer closed end in the radial direction of the impeller, and the outer closed end of the first groove is located at a position forward of a position of the inner open end of the first groove in the rotation direction of the impeller; and a second seal portion is disposed on the second inner surface of the casing and disposed along the second groove, the second seal portion includes a plurality of second grooves defined therein, each second groove extends from an inner open end to an outer closed end in the radial direction of the impeller, and the outer closed end of the second groove is located at a position forward of a position of the inner open end of the second groove in the rotation direction of the impeller.

15. The fuel pump according to claim 1, wherein at least one seal portion is disposed on at least one of the lower and upper surfaces of the impeller, and the seal portion is disposed along the group of concavities.

16. The fuel pump according to claim 1, wherein a first seal portion is disposed on the lower surface of the impeller and disposed along the first group of the concavities, the first seal portion includes a plurality of first grooves defined therein, each first groove extends from an inner open end to an outer closed end in the radial direction of the impeller, the inner open end of the first groove is located at a position forward of a position of the outer closed end of the first groove in the rotation direction of the impeller; and a second seal portion is disposed on the upper surface of the impeller and disposed along the second group of concavities, the second seal portion includes a plurality of second grooves defined therein, each second groove extends from an inner open end to an outer closed end in the radial direction of the impeller, and the inner open end of the second groove is located at a position forward of a position of the outer closed end of the second groove in the rotation direction of the impeller.

* * * * *